United States Patent [19]

Holloway

[11] Patent Number: 4,579,034

[45] Date of Patent: Apr. 1, 1986

[54] BOLT ASSEMBLY AND CARTRIDGE FEED MECHANISM FOR AUTOMATIC FIREARM

[76] Inventor: Robert C. Holloway, Fort Worth, Tex.

[21] Appl. No.: 532,602

[22] Filed: Sep. 15, 1983

[51] Int. Cl.[4] ..... F41D 10/20; F41C 25/02

[52] U.S. Cl. ..... 89/33.1; 42/18; 42/22

[58] Field of Search ..... 42/18, 22; 89/33.1

[56] References Cited

U.S. PATENT DOCUMENTS

| | | | |
|---|---|---|---|
| 984,263 | 2/1911 | Browning | 42/18 |
| 1,059,245 | 4/1913 | Wesson | 42/18 |
| 1,104,947 | 7/1914 | Winks | 42/17 |
| 1,132,044 | 3/1915 | Stamm | 42/18 |
| 1,502,676 | 7/1924 | Kewish | 42/18 |
| 2,571,132 | 10/1951 | Harvey | 42/69 B |
| 2,881,547 | 4/1959 | Butler | 42/22 |
| 3,003,274 | 10/1961 | Morse et al. | 42/17 |
| 3,044,203 | 7/1962 | Wilhelm et al. | 42/22 |

*Primary Examiner*—Charles T. Jordan
*Assistant Examiner*—Ted L. Parr
*Attorney, Agent, or Firm*—Hubbard, Thurman, Turner & Tucker

[57] ABSTRACT

A repeating firearm includes a bolt carrier and bolt assembly which are movable relative to each other to provide for locking and unlocking the bolt with respect to the barrel breech. An elongated bearing plate is supported by the bolt and movable with the bolt to maintain a cartridge to be next inserted into the barrel chamber in a predetermined position until the bolt is substantially fully retracted to prevent premature movement of the cartridge upon movement of the bolt carrier only. The bolt carrier and bolt assembly are interconnected by a cam mechanism including a helical cam slot formed in the bolt carrier and a cylindrical pin type cam follower engageably with the bolt. The bolt, cam follower and an elongated firing pin are maintained in assembly with the bolt carrier by a firing pin retainer which is locked in a pin retaining position by a movable member which permits movement of the firing pin retainer at will to release the firing pin for removal from the bolt assembly without complete removal of the pin retainer from the bolt carrier. A bolt lockout pin includes an actuating lever mounted on a support plug which may be reversibly mounted on the stock section for interchanging the lever from one side of the stock section to the other.

14 Claims, 11 Drawing Figures

BOLT ASSEMBLY AND CARTRIDGE FEED MECHANISM FOR AUTOMATIC FIREARM

BACKGROUND OF THE INVENTION

1. Field of the Invention

The present invention pertains to a sliding bolt and bolt carrier assembly for feeding cartridges into the barrel breech of a repeating type firearm such as a semi-automatic or automatic rifle. The bolt assembly also includes an improved arrangement for releasably retaining the firing pin, and a stop mechanism is associated with the bolt carrier to indicate when the cartridge magazine is empty.

2. Background

Semi-automatic and automatic repeating firearms are typically provided with a bolt assembly which includes a bolt carrier slidable with respect to the breech bolt to provide for a locking and unlocking action of the bolt with respect to the barrel breech in the loading and extraction of cartridges. The proper feeding of a cartridge from a magazine during the action of the bolt and bolt carrier assembly to extract a spent cartridge and load a fresh cartridge into the breech has presented several problems to the art worker in regard to the provision of a mechanism which will unerringly feed a fresh cartridge from the magazine into proper position in the barrel chamber prior to locking the bolt and firing the projectile. The action of the bolt to extract and load a fresh cartridge must, of course, be reliable, particularly in regard to semi-automatic and automatic weapons.

One problem of longstanding with prior art repeating firearms pertains to the tendency for the cartridge in position to be next inserted into the barrel chamber to cock or jam during the movement of the bolt and bolt carrier to extract a spent cartridge and load a fresh cartridge into the chamber. This problem is particularly difficult to overcome wherein the bolt and bolt carrier move relative to each other because of the clearance provided between the two parts which will allow unwanted movement of the cartridge in position to be loaded into the breech into an intermediate skewed position which may result in jamming of the cartridge under the bolt to thereby prevent completion of the extracting and loading action of the bolt.

Although various types of retractable bolt mechanisms have been developed for repeating firearms, the type of action which provides for relative movement between a bolt carrier member and a locking bolt member has not been developed which is completely reliable and provides for feeding a fresh cartridge unerringly into the empty barrel chamber. This problem is particularly actue with firearms adapted to feed cartridges from a spring loaded, so called clip type magazine.

Another problem associated with bolt assemblies for semi-automatic and automatic firearms pertains to the retention of the firing pin in the bolt by a suitable mechanism which may be locked to prevent removal of the firing pin and which may be unlocked to permit removal of the firing pin from the bolt without loss of the retention mechanism itself. This is particularly important during field disassembly and cleaning or repair in that the parts normally associated with retaining the firing pin in the bolt are relatively small and easily lost.

The present invention overcomes several problems, including those discussed above, associated with repeating type firearms such as semi-automatic and automatic rifles.

SUMMARY OF THE INVENTION

The present invention pertains to an improved bolt and bolt carrier assembly for use in conjunction with a repeating type firearm such as a semi-automatic or automatic rifle.

In accordance with one aspect of the present invention there is provided an improved configuration of a bolt and bolt carrier assembly for a repeating firearm wherein cartridges in position to be next inserted into the barrel chamber are retained in the magazine during movement of the bolt and bolt carrier through an extraction and ejection stroke without a tendency to cock or jam the cartridge which is biased into position for next insertion into the chamber. In particular, the bolt and bolt carrier assembly is provided with an elongated bearing plate member which is connected to and movable with the bolt and bears against the cartridge which is in position to be next inserted into the chamber to retain the cartridge properly oriented in the magazine to prevent premature movement of the cartridge until the bolt has retracted sufficiently to clear the cartridge casing. In this way, cartridges disposed directly side-by-side or in a staggered arrangement in the magazine may be fed into the breech while minimizing the chances of jamming the action during cartridge loading operations.

In accordance with another aspect of the present invention there is provided an improved bolt and bolt carrier assembly for a semi-automatic rifle wherein the bolt, the improved cartridge bearing plate, and a cam follower engaged with the bolt and movable in a cam slot formed in the bolt carrier are easily disassembled for removal and cleaning of the component parts.

In accordance with a further aspect of the invention the bolt assembly includes a firing pin which is removably insertable in the bolt and is operable to retain the bolt, the cam follower and the cartridge feed plate in assembly with the bolt carrier whereby these parts may be easily disassembled for cleaning and/or replacement. The firing pin itself is also retained in the bolt carrier by an improved retainer mechanism which permits purposeful removal of the firing pin without risk of loss of component parts of the retainer mechanism and also assures that the firing pin remains in its working position when the bolt and bolt carrier are inserted in the receiver member.

In accordance with yet a further aspect of the present invention there is provided an improved bolt assembly lockout mechanism for holding the bolt and bolt carrier in the retracted position when the last cartridge has been extracted from a clip type cartridge magazine. The lockout mechanism includes a reversible actuating lever for manually actuating a bolt lockout pin to move between locking and unlocking positions. The actuating lever and a support member therefor may be disposed on the left or right side of the stock for right or left hand operation of the lockout pin at will.

Those skilled in the art will further appreciate the above described advantages and features of the present invention as well as other superior aspects thereof upon reading the detailed description which follows in conjunction with the drawing.

DESCRIPTION OF THE PREFERRED EMBODIMENT

Figure 1:
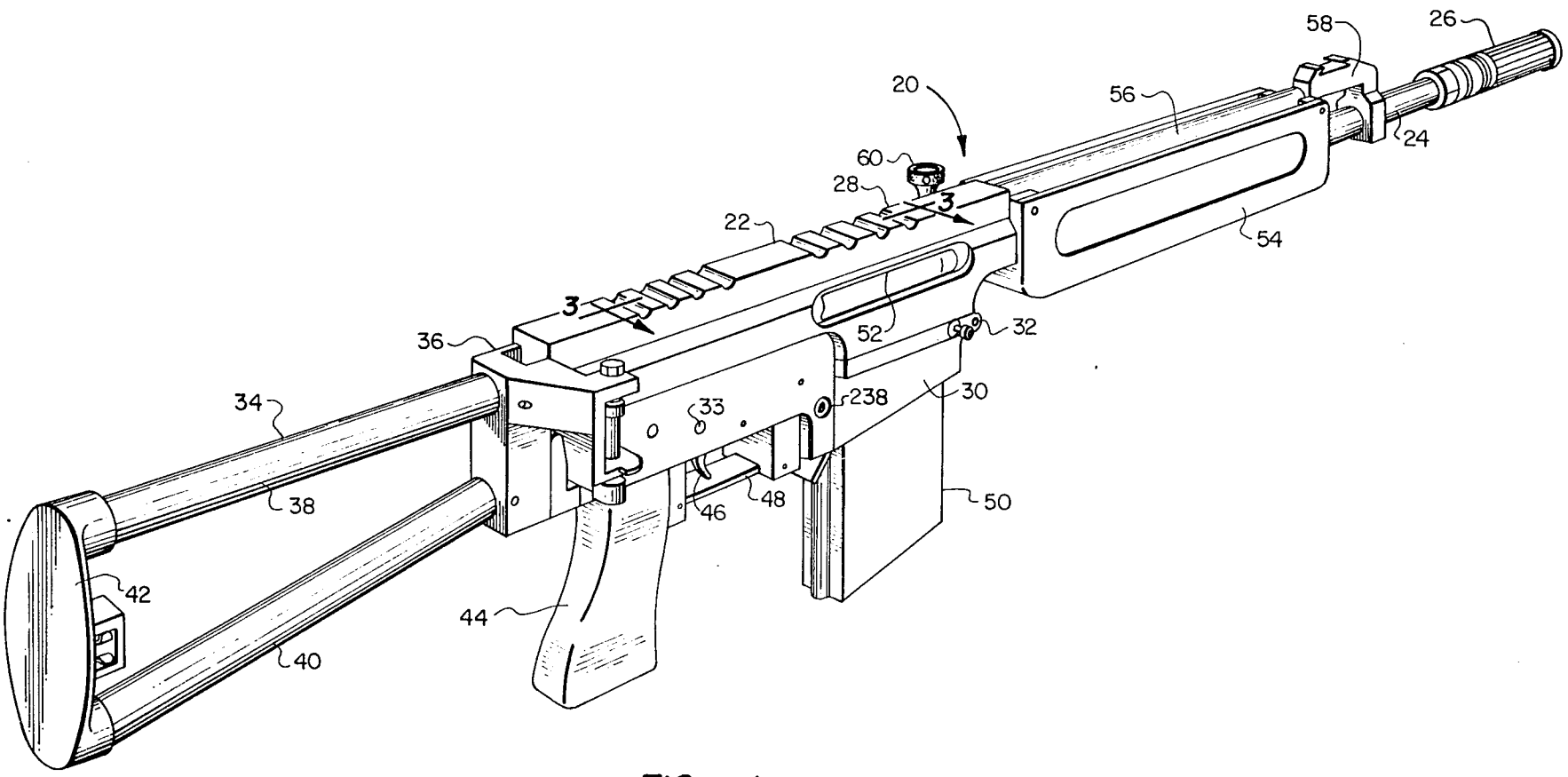
FIG. 1 is a perspective view of a semi-automatic rifle including the bolt assembly and other features of the present invention.

In the description which follows like parts are marked throughout the specification and drawing with the same reference numerals, respectively. The drawing figures are not necessarily to scale and certain features of the invention may be shown exaggerated in scale in the interest of clarity and conciseness.

Referring to FIG. 1, there is illustrated a repeating type firearm comprising a semi-automatic rifle, generally designated by the numeral 20. The rifle 20 comprises an elongated integral housing 22 to which is secured a rifled barrel 24 having a flash arrestor 26 disposed at the muzzle end thereof. The housing 22 is of two piece construction and includes an upper receiver section 28 which is hingedly connected to a lower stock section 30 for pivotal movement about a hinge 32. The receiver section 28 is secured to the stock section 30 by an elongated pin 33 insertable through cooperating bores in both sections. The rifle 20 is further characterized by a foldable butt 34 including a member 36 hinged to the rearward end of the stock section 30 and supportive of elongated tubular butt members 38 and 40. A cast metal butt plate 42 is adapted to receive the rearward ends of the tubular butt members 38 and 40. The rifle 20 is further characterized by a pistol grip 44 suitably secured to the stock section 30 behind a trigger 46 disposed within the confines of a trigger guard 48. A removable clip type magazine 50 is insertable in a cooperating recess formed in the lower face of the stock section 30 and will be described in further detail herein. The receiver section 28 is provided with an elongated cartridge ejection slot 52 to provide for ejection of spent cartridges by the improved bolt assembly and feed mechanism of the present invention. The rifle 20 is also provided with a suitable forearm member 54 supported on the barrel 24.

The rifle 20 is of a type which is operated by the expanding projectile propellant gases for effecting ejection of a spent cartridge, loading a fresh cartridge into the barrel breech and chamber and locking the bolt in a closed position preparatory to firing. In this regard, the rifle 20 is provided with an elongated cylinder 56 supported at its forward end by a housing member 58 secured to the barrel 24 and including suitable passage means, not shown, in communication with the barrel bore with the interior of the cylinder 56 for conducting high pressure gases into the cylinder to actuate an elongated rod, not shown in FIG. 1, for actuating the cartridge loading and extraction mechanism. A manual actuating lever 60 is also provided for manual actuation of the loading and extraction mechanism referenced herein. It will be understood that the present invention may be used in conjunction with firearms which are gas operated as well as recoil or manually operated, or by other means to extract and reload cartridges. The inventive features are not confined to firearms with rifled barrels, although the specific embodiment described herein is particularly adapted for gas operated semi-automatic rifles designed for a wide range of projectile calibers.

Figure 4:
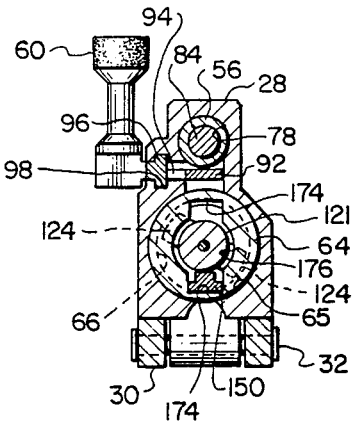
FIG. 4 is a transverse section view taken along the line 4—4 of FIG. 3.
Figure 3:
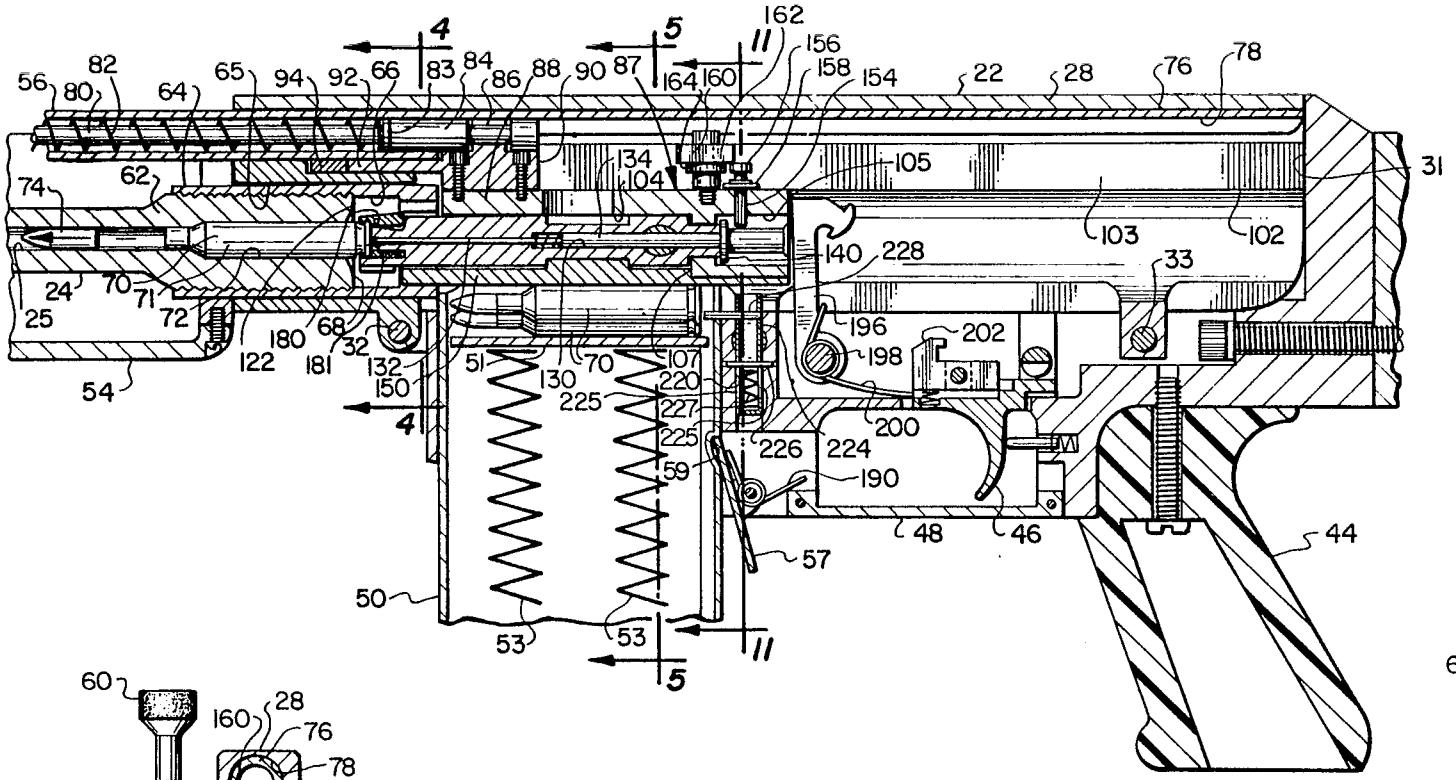
FIG. 3 is a longitudinal section view taken substantially along the line 3—3 of FIG. 1.
Figure 7:
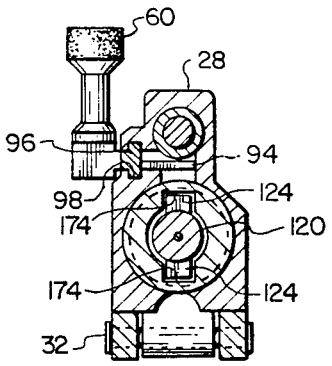
FIG. 7 is a transverse section view taken along the line 7—7 of FIG. 6.

Referring now to FIG. 3, in particular, the barrel 24 is provided with an enlarged rearward portion 62 which is adapted to be threadedly inserted in a breech fitting 64, the latter being suitably secured in a bore 65 in the receiver section 28. The fitting 64 is provided with a cylindrical groove or recess 66 just rearward of the breech 68. The view of FIG. 3 illustrates a cartridge 70 inserted in the chamber 72 of the barrel 24 and a projectile 74 having just been fired and being propelled through the rifled bore 25. The lower side of the rearward end of the cylinder 56 is cut away to provide an upper supporting section 76 which extends into an elongated bore 78 in the receiver section 28. The aforementioned actuating rod for the bolt assembly of the present invention is indicated by the numeral 80 in FIG. 3 and is disposed within a bore formed in the cylinder 56 and extending through a coil spring 82 also disposed in the bore of the cylinder 56. The spring 82 is suitably retained in the cylinder at 83. The rod 80 extends to a terminal end portion 84 provided with a circumferential groove 86 which is adapted to be connected to a bolt assembly 87, including a bolt carrier 88, by an intermediate connecting member 90. The member 90 includes a forward projecting finger portion 92 which is engageable with a cooperating finger portion 94, FIG. 3, projecting laterally from an elongated slide 96, FIGS. 4 and 7. The slide 96 is adapted to be slidable in a cooperating slot 98 extending longitudinally along one side of the receiver section 28. The slide 96 is suitably connected to the lever 60 so that, upon retraction of the lever towards the butt 34, the bolt carrier 88 and the rod 80 may be manually actuated rearwardly within the receiver section 28.

Figure 2:
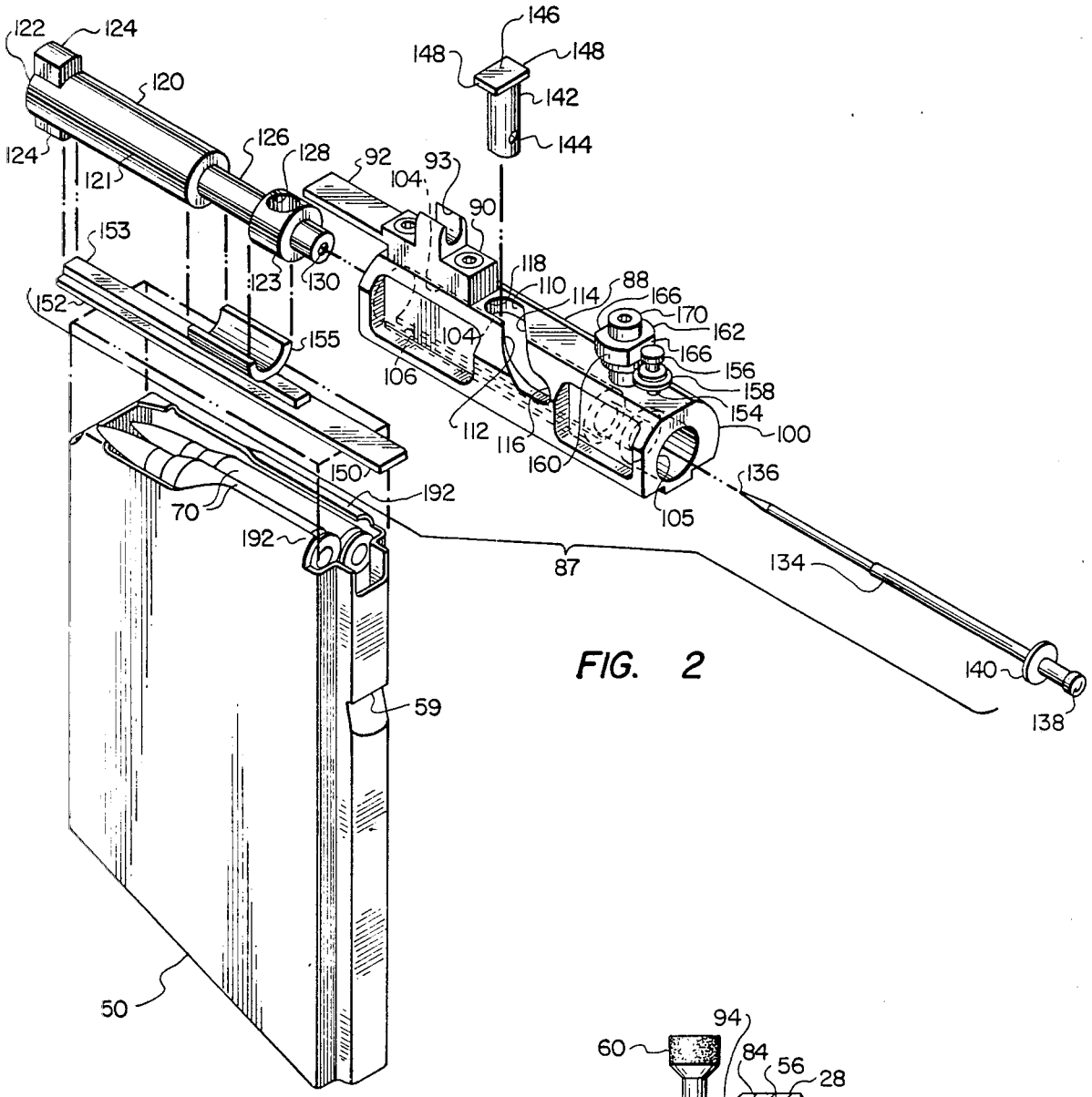
FIG. 2 is an exploded perspective view of the bolt assembly including the improved cartridge bearing plate and firing pin arrangement.

Referring now to FIGS. 2 and 3, in particular, it will be noted that the member 90 is suitably removably secured to the bolt carrier 88 and is provided with a vertically projecting portion forming a somewhat U shaped recess 93 adapted to receive the reduced diameter portion 86 of the rod 80. The bolt carrier 88 is also configured as a somewhat elongated cylindrical member having at least a partial outer cylindrical bearing surface 100 adapted to slidably support the bolt carrier in an elongated bore portion 102, FIGS. 5 and 11, extending longitudinally within the receiver section 28 and parallel to the bore 78. A connecting recess between the bores 78 and 102 is delimited by opposed sidewalls 103 also indicated in FIG. 11. The bolt carrier 88 includes an elongated stepped bore 104, FIGS. 2 and 3, extending longitudinally through the bolt carrier and being intersected by a longitudinal slot 106, FIGS. 2 and 5, extending along the bore 104 to a shoulder 107, FIG. 3. The bolt carrier 88 is also provided with a cam slot 110 defined in part by opposed helical cam surfaces 112 and 114 having a helix angle of approximately 45° and intersecting axially extending slot portions 116 and 118 at opposite ends of the slot.

The improved bolt assembly 87 also includes an elongated cylindrical bolt 120 having a forward end face 122 including a pair of opposed radially projecting lugs 124 forming a portion thereof. The bolt 120 also includes a reduced diameter portion 126, a transverse cylindrical hole 128 and a longitudinal cylindrical bore 130 extending therethrough and having a reduced diameter portion 132, FIG. 3, for receiving an elongated firing pin 134. The firing pin 134 includes a forward pointed end 136, a striking end 138 and an integral cylindrical collar portion 140 formed adjacent to the striking end. The bolt 120 is adapted to be slidably fitted in the bore 104 of the bolt carrier 88 in close fitting axial sliding relationship therein and also is adapted to be rotated with respect to the bore through a limited rotation angle as determined by a cylindrical pin type cam follower, illustrated in FIG. 2 and generally designated by the numeral 142. The cam follower 142 also includes an integral rectangular head portion 146 having opposed guide surfaces 148 formed thereon.

Figure 5:
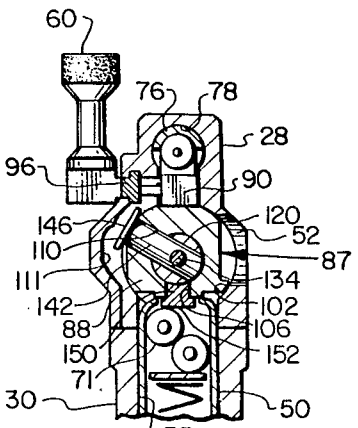
FIG. 5 is a transverse section view taken along the line 5—5 of FIG. 3.

In accordance with a particularly unique aspect of the present invention the bolt assembly illustrated in FIG. 2 includes an elongated cartridge bearing or feed plate, generally designated by the numeral 150, which includes an elongated downwardly facing cartridge bearing surface 152, an elongated integral key portion 153 and a half cylindrical saddle portion 155 integrally formed with the remainder of the plate 150. The saddle portion 155 is adapted to be closely fitted on the reduced diameter portion 126 so that the exterior cylindrical surface of the bolt 120 forms a continuous cylinder surface along the lower half of and between the cylindrical sections 121 and 123, FIG. 2. Moreover, the key section 153 is adapted to fit in the slot 106 so that the bolt 120 and the bearing plate 150 may be slidably disposed in assembly within the bore 104 in the bolt carrier. When the bolt 120 and the bearing plate 150 are in assembled relationship and disposed in the bore 104, the bolt is adapted for limited axial and rotational movement with respect to the bolt carrier 88 by the cam follower 142 which is insertable in the hole 128 through the cam slot 110. Referring also to FIGS. 3 and 5, the assembled relationship of the bolt 120, the cam follower 142, the firing pin 134 and the bolt carrier 88 is illustrated. Moreover, the operative position of the cartridge bearing plate 150 is also shown with the bearing surface 152 operably engaged with a cartridge 70 and particularly the casing 71 thereof.

Referring further to FIGS. 2 and 3, the firing pin 134 is retained in assembly with the cam follower 142, the bolt 120 and the bolt carrier 88 by a unique retaining mechanism including a retaining pin 154 which is disposed in a transverse hole formed in the bolt carrier 88 and projects into a bore portion 105 aligned with the bore 104. The retaining pin 154 includes a head portion 156 and an integral stop collar 158 spaced from and below the head portion 156. As shown in FIG. 3, with the firing pin 134 disposed in the bore 130, the integral collar 140 on the firing pin is disposed in the bore 105 and is prevented from ejection from the bore by the distal end of the retaining pin 154 to prevent removal of the firing pin from the carrier 88. The retaining pin 154 is prevented from movement out of the bore 105 by a pin locking member, generally designated by the numeral 160 and including stepped flanges 162 and 164. The flange 162 includes opposed flats 166, FIG. 2, which efectively relieves the cross-sectional dimension of the flange and permits extension of the retaining pin 154 upward and out of the bore 105, as indicated by the position of the retaining pin 154 in FIG. 2. However, the stop collar 158 is engageable with the flange 162 to prevent complete extraction of the retaining pin 154 from its bore in the bolt carrier 88.

In the position of the retaining pin 154 illustrated in FIG. 3, the pin head 158 and the retainer flange 162 are engageable to prevent extraction of the pin 154 from the bore 105 thereby retaining the firing pin 134 in its assembled position with respect to the bolt 120 and the cam follower 142. The member 160 is operable to be secured on the bolt carrier 88 by a suitable shoulder screw 170 and may be rotated to position the flats 166 between the position shown in FIG. 2 and the position shown in FIGS. 3 and 11. When the member 160 is rotated to the position illustrated in FIGS. 3 and 11, and the bolt carrier 88 is disposed in the receiver section 28 the flats 166 are disposed in close fitting relationship to the surfaces 103 in the receiver section 28 to prevent rotation of the member 160 to the position shown in FIG. 2. Accordingly, when the bolt assembly 87 is disposed in the bore 102 the firing pin 134 is maintained in its assembled position within the bolt and bolt carrier assembly and may not be inadvertently extracted or ejected from the bore 130. When the bolt 120 and the bolt carrier 88 are removed from the receiver section 28, the member 160 may be rotated to orient the flats 166, as shown in FIG. 2, whereby the retainer pin 154 may be lifted sufficiently to permit extraction of the firing pin 134 from the bore 130 but the retainer pin 154 may not be removed completely from the bolt carrier 88 thus avoiding any chance of losing the retainer pin.

Referring again to FIGS. 3 and 4, the fitting 64 includes a pair of opposed radially projecting slots 174, FIG. 4, which open into the circumferential groove 66 and also intersect a cylindrical bore portion 176. The slots 174 are adapted to permit movement of the lugs 124 into the groove 66 whereby, upon rotation of the bolt 120, the lugs 124 may be moved to the position shown in FIG. 4 to lock the bolt in the closed position. When a cartridge is to be extracted from the chamber 72 the bolt 120 is rotated clockwise, viewing FIG. 4, until the lugs 124 are aligned with the slots 174 thereby permitting axial movement of the bolt rearwardly of the breech 68. As shown in FIG. 3, the bolt 120 also includes a suitable cartridge extraction cam 180 which is adapted to engage the rim or flange 181 of a cartridge casing 71 to extract a spent cartridge from the chamber 72. The cam 180 is adapted to engage the wall of the bore 104 to pivot clear of the cartridge flange and may be assisted in ejecting the cartridge through the ejection slot 52 by a suitable spring biased ejector pin on the bolt 120.

Referring further to FIGS. 3 and 5, when the bolt 120 and the bolt carrier 88 are in the position illustrated, the bearing plate 150 overlies the magazine 50 and bears against the next to be fired cartridge 70 to hold that cartridge as well as other cartridges in the magazine in a position oriented forwardly and substantially aligned in the magazine so that the cartridge may be unerringly fed into the chamber 72 upon retraction of the bolt 120. The magazine 50 includes a suitable elevator plate 51 which is biased upwardly, viewing FIG. 3, by spring means 53. The magazine 50 is releasably retained in a recess 55 formed in the lower stock section 30 by a spring biased retainer member 57 which is pivotally supported on the stock section 30 and is biased into a magazine locking notch 59 by a torsion coil spring 190. The magazine 50 is also provided with inwardly curved retainer flanges 192, FIG. 2, to assist in maintaining the cartridges 70 properly oriented in the magazine.

Figure 9:
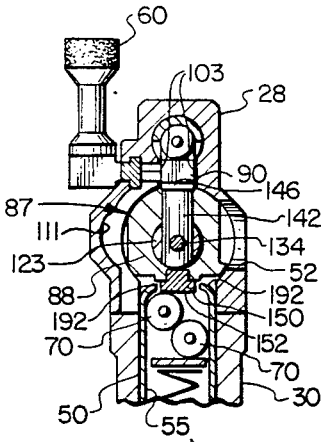
FIG. 9 is a transverse section view taken along the line 9—9 of FIG. 6.

In the position of the bolt 120 and the bolt carrier 88 shown in FIGS. 3, 4, 5 and 11 the firing pin 134 has just been struck by a hammer 196 which is pivotally mounted on the stock section 30 by a suitable pivot pin 198 and is biased into the firing position by torsion coil spring 200. The trigger 46 is suitably connected to a sear 202 which is operable to hold the hammer 196 in a cocked position and to release the hammer for striking the firing pin upon pulling the trigger 46 in a conventional manner. Upon firing a cartridge 70, the high pressure gases generated in propelling the projectile 74 through the barrel bore 25 will, upon reaching the aforementioned ports, not shown, effect actuation of the rod 56 to commence axial retraction of the bolt carrier 88 in the bore 102. Since the member 90 is closely fitted for sliding movement in the guideway formed between the surfaces 103, the bolt carrier 88 is prevented from rotating about its longitudinal axis. Accordingly, the axial movement of the bolt carrier 88 will cause the cam follower 142 to rotate the bolt 120 clockwise, viewing FIG. 4, as the cam follower moves from the end 116 of the cam slot 110 along the cam surfaces 112–114 to the opposite end 118. The receiver section 28 is relieved at 111, FIGS. 5 and 9, to provide clearance for the cam follower head 146. The relief 111 intersects the guideway formed by surfaces 103 only at the positions where the section planes for FIGS. 5 and 9 are located. The configuration of the cam slot 110 is such that it will provide for rotation of the bolt 120 from the position illustrated in FIG. 4 to the position illustrated in FIGS. 6 and 7 whereby the lugs 124 are aligned with the slots 174. Once the bolt 120 has been rotated to the position illustrated in FIGS. 6 and 7 further axial movement of the bolt carrier 88 rearwardly will result in axial movement of the bolt 120 with the bolt carrier to the positions illustrated in FIGS. 8 and 10.

When the cam follower 142 moves into the slot end portion 118 the head 146 is disposed in the guideway formed by the surfaces 103 and further movement of the bolt carrier 88 rearwardly may occur without unwanted rotation of the bolt 120. During movement of the bolt carrier 88 from the FIG. 3 position to the FIG. 6 position no axial movement of the bolt 120 or the bearing plate 150 has occurred. Accordingly, thanks to the provision of the cartridge bearing plate 150, the cartridge 70 in position to be next loaded into the chamber 72 will remain in the position shown in FIG. 6 engaged with the bearing plate 150. The bearing plate 150 is prevented from rotating with the bolt 120 by the key portion 153 which is always at least partially disposed in slot 106. Moreover, in the bolt closed position shown in FIGS. 3 and 4, the forward end of the bearing plate 150 projects into the lower slot 174.

Figure 6:
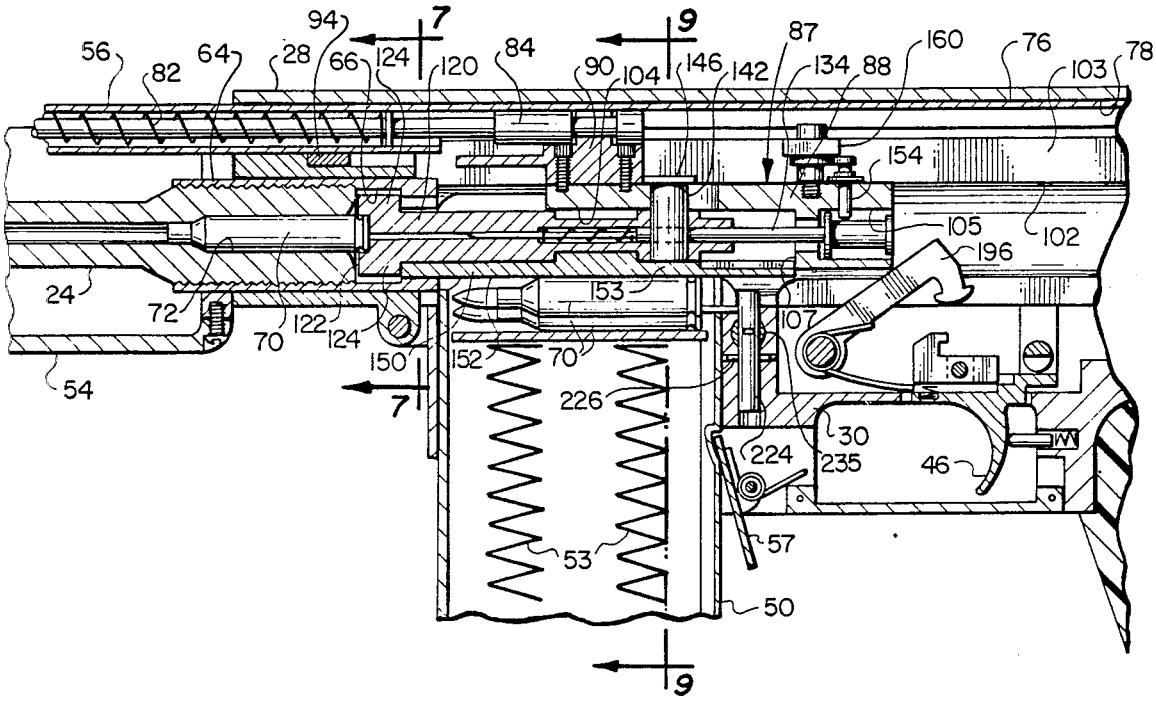
FIG. 6 is a longitudinal section view taken from the same line as the section view of FIG. 3 and showing the bolt assembly in the position just prior to retraction of the bolt away from the barrel breech.
Figure 8:
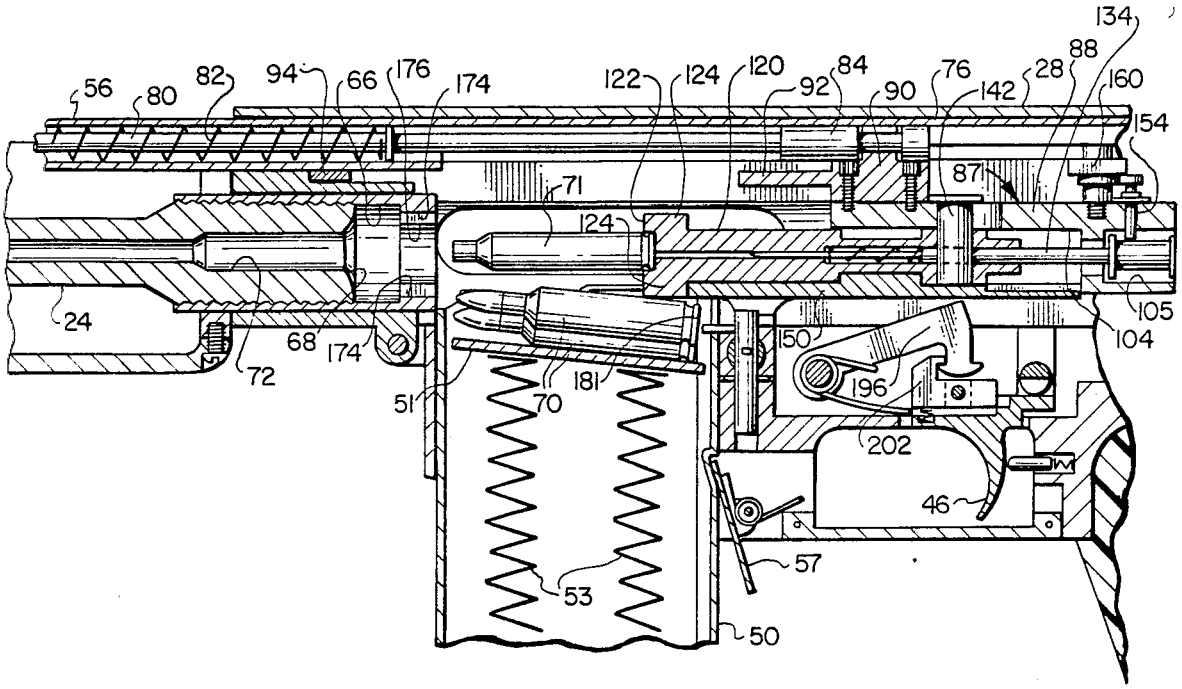
FIG. 8 is a longitudinal section view similar to FIG. 6 and showing the bolt and bolt carrier in the position at which a spent cartridge is ejected from the receiver.
Figure 10:
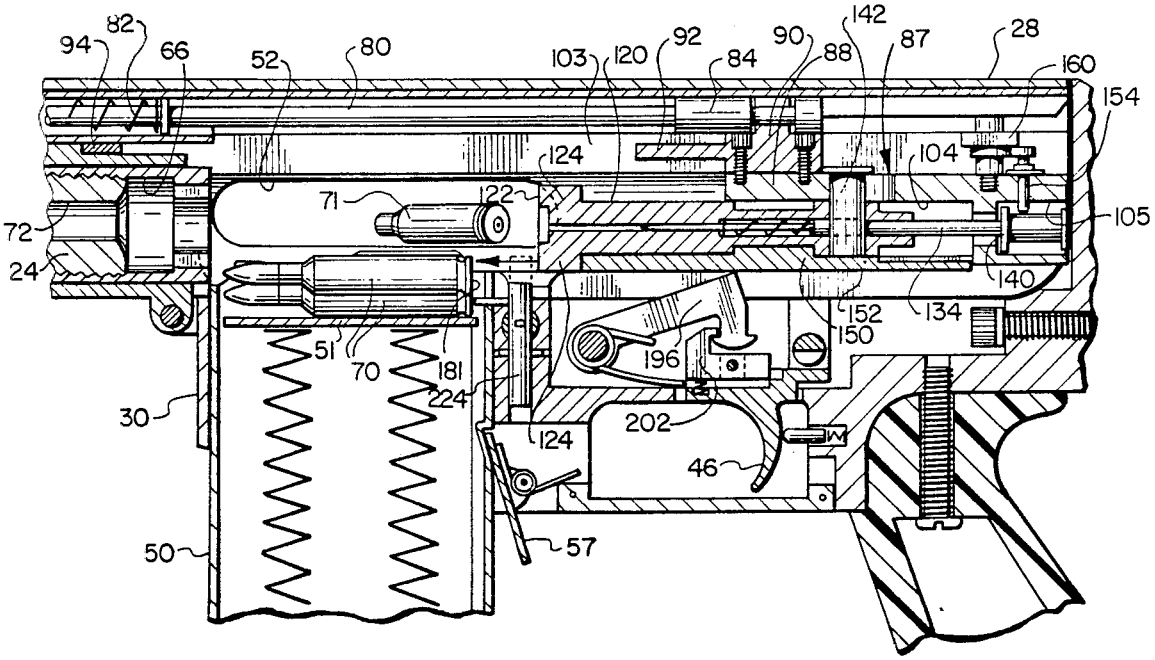
FIG. 10 is a longitudinal section view similar to the views of FIGS. 3, 6 and 8 showing the bolt in a fully retracted position prior to movement toward loading of a fresh cartridge into the barrel chamber.

As the bolt carrier 88 and bolt 120 move rearwardly in the receiver section 28 from the position of FIG. 6 to the positions of FIGS. 8 and 10, the spent cartridge is pulled from the chamber 72 by the bolt 120 and extractor cam 180. As the forward end of the cartridge casing 71 clears the breech 68 the aforementioned ejector pin ejects the cartridge through the slot 52 during movement of the bolt through the positions shown in FIGS. 8 and 10. As indicated in FIG. 8, rearward movement of the bolt carrier 88 and bolt 120 pivots the hammer 196 clockwise, viewing FIG. 10, to recock the hammer by engagement with the sear 202.

As indicated in FIG. 8, as the forward end of the bolt 120 moves clear of the cartridge 70 to be next loaded into the chamber 72 the cartridges in the magazine 50 may tilt slightly until the forward end of the bolt moves rearward of the casing flange 181 to the position shown in FIG. 10. In the position shown in FIG. 10, the cartridges 70 have moved upward until the uppermost cartridge is in engagement with one of the flanges 192 to prevent further movement of the cartridges out of the magazine 50. The position of the bolt carrier 88 and the bolt 120 illustrated in FIG. 10 is the maximum rearward position of this assembly and is one wherein the gases propelling the rod 80 have been vented from the cylinder 56 and the compression of the spring 82 is sufficient to return the bolt assembly 87 back toward the position of FIG. 3. As the bolt 120 moves toward the breech 68, the transverse end face 122 including a portion of the lower lug 124 will engage the rear end of the cartridge 70 in the highest elevated position in the magazine 50 to move the cartridge through the bore 176 and into firing position in the barrel chamber 72. As the bolt 120 moves to its forwardmost position corresponding to the positions of FIGS. 3 and 4 continued forward movement of the bolt carrier 88 under the urging of the rod 80 will cause the cam follower 142 to traverse the slot 110 from the end 118 back to the end 116 thereby effecting rotation of the bolt 120 to its closed and locked position. As the bolt 120 and the bearing plate 150 move forwardly to strip the uppermost cartridge 70 from the magazine 50 and propel the cartridge into the chamber 72 the bearing plate 150 engages the next cartridge 70 in position to be loaded into the firing chamber and maintains that cartridge in a predetermined position which will not interfere with the movement of the bolt carrier 88 and the bolt 120 relative to each other during the loading, bolt locking and subsequent extraction movement of the bolt and bolt carrier.

Figure 11:
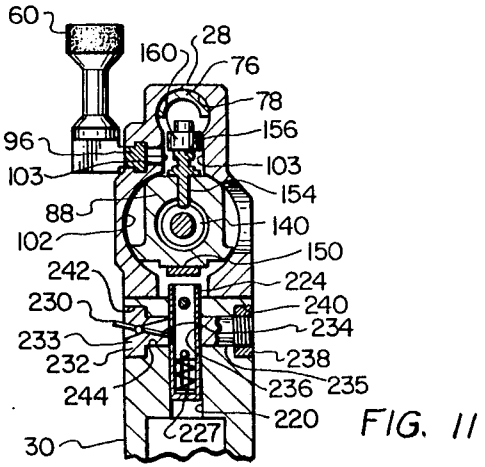
FIG. 11 is a transverse section view taken along the line 11—11 of FIG. 3.

Referring now to FIGS. 3 and 11, the rifle 20 also includes an improved mechanism for locking the bolt 120 and the bolt carrier 88 in the fully retracted position when the magazine 50 is empty. The stock section 30 includes a vertically extending bore 220 in which is disposed an elongated cylindrical tubular lockout pin 224 having opposed slots 225 adapted to receive a pin 226 projecting through the lockout pin and supported in the stock section 30. A coil spring 227 is disposed in the lockout pin 224 and is engageable with the pin 226 to bias the lockout pin 224 vertically downwardly.

As shown in FIG. 3, the lockout pin 224 includes a lateral projection 228 which is adapted to be engaged by the elevator plate 51 of the magazine 50 when the magazine is empty whereby the springs 53 will bias the lockout pin 224 upwardly, viewing FIGS. 3 and 11, against the bias of the spring 226 into a position whereby the upper distal end of the lockout pin 224 will project into the path of the bolt forward end face 122 to prevent movement of the bolt 120 from the FIG. 10 position back to the bolt closed position. Accordingly, when the magazine 50 has unloaded the last cartridge 70 disposed therein the elevator plate 51 will urge the pin 224 into the bolt lockout position upon retraction of the bolt assembly 87 to the position illustrated in FIG. 10. Upon removal of the clip 50 the pin 224 will again be biased by spring 227 downwardly into an at rest or inoperative position.

Referring further to FIG. 11, the lockout pin 224 is provided with an actuating lever 230 which is pivotally mounted on a support member, generally designated by the numeral 232. The lever 230 includes a key portion 234 which is engageable with the lockout pin 224 to move the pin vertically upward against the bias of the spring 227 into position to manually lockout the bolt assembly 87, if desired. Of course, if the lockout pin 224 has been urged upward by the elevator plate 51 the lever 230 may be moved in the opposite direction to retract the pin 224 against the bias of the elevator plate 51.

The member 232 is characterized as a generally cylindrical threaded plug having a cylindrical shank portion 235 with a transverse bore 236 through which the pin 224 projects in sliding relationship to the member 232. The distal end of the shank portion 235 is threadedly engaged with a cylindrical collar type nut 238. The nut 238 is disposed in a counterbore 240 formed in the stock section 30 and opposite a counterbore 242. The shank portion 235 is disposed in a bore 244 which extends between the counterbores 240 and 242 and intersects the bore 220. The transverse bore 236 is aligned with the bore 220 when the plug 232 is installed in the position shown or is installed in a reverse position wherein the collar type nut 238 is disposed in the counterbore 242 and the head 233 is disposed in the counterbore 240.

The pin 224 may be removed from bore 220 by first removing the retaining pin 226 and then lifting the pin 224 out of its bore. The lever tongue or key portion 234 is allowed to pivot upwardly sufficiently to clear the pin 224 so that it can be removed. Accordingly, by removing the pin 224 from the bore 220 and then removing and reversing the arrangement of the plug 232 in the stock section 30 the manual actuating lever 230 may be reversed or moved from the left side to the right side of the stock section.

The operation of the rifle 20 is believed to be readily understandable from the foregoing description of the various component parts and the description of the operation of the bolt carrier 88 and the bolt 120. The bolt assembly 87 may, of course, be manually actuated at will by movement of the lever 60 and the slide member 96 to retract the bolt carrier 88 to effect unlocking and retraction of the bolt 120 through its operating cycle to extract a cartridge from the chamber 72 and insert a fresh cartridge into the chamber from the magazine 50. Those skilled in the art will appreciate that the bolt assembly 87 may be adapted to be actuated by any suitable mechanism and does not require that the firearm be gas operated in its action. Moreover, the mechanism described herein may be adapted for use with guns having unrifled bores or relatively short barrels. In fact, several configurations may be contemplated utilizing the salient features of the novel bolt assembly.

Removal and reinsertion of the bolt assembly 87 with respect to the receiver section 28 may be effected by removing the pin 33 from the stock section 30 whereby the receiver section 28 may be pivoted about the hinge 32 clear of the transverse endwall 31, FIG. 3. The bolt assembly 87 may then be moved rearwardly in the receiver section 28 out of the bore 102. The rod 80 may be extracted in its bore 78 rearwardly also until the member 90 can be moved laterally to disconnect it from the rod section 84. With the bolt assembly 87 removed from the receiver section 28 the retainer pin locking member 160 may be rotated to orient the flats 166 in the position shown in FIG. 2 so that the retainer pin 154 may be lifted until the collar 158 engages the flange 164 to allow removal of the firing pin 134 from the bore 132. Upon removal of the firing pin 134 the cam follower 142 may be removed from its bore 128 and the bolt 120 then removed from the bore 104. Reassembly of the bolt 120 may, of course, be carried out in substantially the reverse order. When it is desired to place the bolt assembly in the bore 102 the locking member 160 is rotated so that the flats 166 are aligned with the guideway surfaces 103 and the flange 162 prevents movement of the retainer pin 154 out of the bore 105 sufficiently to permit removal of the firing 134.

The operation of the bolt carrier 88 and the bolt 120 in conjunction with the cartridge bearing plate 150 has resulted in much improved, unerring repeater action on a semi-automatic rifle designed for firing a 7.62×51 mm NATO caliber cartridge. Although a preferred embodiment of the invention has been described in detail herein those skilled in the art will recognize that various substitutions and modifications may be made to the specific embodiment disclosed without departing from the scope and spirit of the invention as recited in the appended claims.

What I claim is:

1. A repeating firearm including a barrel having a chamber for receiving a cartridge to be fired by said firearm, a receiver section including means for receiving a sliding bolt assembly, and a magazine for storing a plurality of cartridges for feeding said cartridges seriatim to said chamber in response to operation of said bolt assembly, said bolt assembly comprising:

a bolt carrier slidably disposed in said receiver section;

a breech bolt slidably disposed on said bolt carrier and movable with said bolt carrier and relative to said bolt carrier;

means interconnecting said bolt carrier and said bolt and operable upon movement of said bolt carrier relative to said bolt to effect locking and unlocking movement of said bolt with respect to said barrel; and bearing means engageable with a cartridge in said magazine in a predetermined position to be fed into said chamber for holding said cartridge in said position during at least part of movement of said bolt carrier relative to said bolt to unlock said bolt and extract a spent cartridge from said chamber, said bearing means connected to said bolt with cradling means to permit axial rotation of said bolt and slidably mounted within said bolt carrier for movement with said bolt during movement of said bolt away from said chamber to provide clearance for a cartridge to move into position for engagement by said bolt to load said cartridge into said chamber.

2. The firearm set forth in claim 1 wherein:
said bearing means comprises an elongated plate extending substantially from a foreward end of said bolt to the forward end of said bolt carrier when said bolt carrier has moved a major portion of the distance relative to said bolt to maintain a cartridge in said magazine in said predetermined position.

3. The firearm set forth in claim 1 wherein:
said bearing means includes an elongated bearing plate connected to said bolt and extending along a side of said bolt between said bolt and said magazine.

4. The firearm set forth in claim 3 wherein:
said bolt comprises an elongated cylindrical member slidably disposed in a cylindrical bore formed in said bolt carrier, said bore intersecting an elongated slot formed in said bolt carrier, and said bearing plate includes a key portion slidably disposed in said slot.

5. The firearm set forth in claim 4 wherein:
said bolt includes a reduced diameter portion forming a groove for receiving a cylindrical saddle portion on said bearing plate whereby said bolt may be rotated relative to said bearing plate about a longitudinal axis of said bolt, and said saddle portion forms said connection between said bolt and said bearing plate for moving said bearing plate axially with said bolt.

6. The firearm set forth in claim 3 wherein:
said bolt comprises an elongated cylindrical member slidably disposed in a bore formed in said bolt carrier, said bolt carrier and said bolt including cooperating cam and cam follower means operable upon movement of said bolt carrier when said bolt is in a closed and locked position with respect to said chamber to rotate said bolt relative to said bolt carrier to unlock said bolt and then move said bolt axially to clear the breech of said barrel for insertion of a cartridge into said chamber.

7. The firearm set forth in claim 6 wherein:
said cam comprises a pair of opposed cam surfaces formed by a slot in said bolt carrier, and said cam follower means comprises a radially projecting pin member disposed on said bolt and projecting radially into said slot.

8. The firearm set forth in claim 7 wherein:
said cam follower means includes surfaces formed thereon cooperable with a guideway formed in said receiver section to prevent rotation of said bolt relative to said bolt carrier when said bolt is moved away from the breech of said barrel.

9. The firearm set forth in claim 7 wherein:
said bolt includes an elongated bore, a firing pin disposed in said bore and extending through a bore in said cam follower means for retaining said cam follower means, said bolt, and said bearing plate in assembly with said bolt carrier.

10. The firearm set forth in claim 9 wherein:
said bolt carrier includes a retainer pin cooperable with said firing pin to retain said firing pin in assembly with said bolt and said bolt carrier, said retainer pin including a head portion, and a locking member mounted on said bolt carrier for movement between a first position engageable with said head portion to prevent said retainer pin from moving to release said firing pin and a second position to permit limited movement of said retainer pin to relese said firing pin for removal from said bolt without removing said retainer pin from said bolt carrier.

11. The firearm set forth in claim 10 wherein:
said locking member comprises a portion forming a flange engageable with said head portion in said first position, and a relieved surface on said flange providing clearance for limited movement of said retainer pin in a second position of said flange.

12. The firearm set forth in claim 11 wherein:
said relieved surface is cooperable with a guideway formed in said receiver section to prevent movement of said locking member from said first position when said bolt carrier is disposed for operation in said receiver section.

13. The firearm set forth in claim 11 wherein:
said locking member is rotatably disposed on said bolt carrier for movement between said first and second positions and said retainer pin includes a collar portion engageable with said locking member in either position of said locking member to prevent removal of said retainer pin from said bolt carrier.

14. The combination of claim 1 wherein;
said bearing means includes a rectangular bearing plate for contact with said cartridge extending from the lower edge of said bolt carrier positioned over said magazine which provides enhanced individualized loading of cartridges.

* * * * *